US005394811A

United States Patent [19]

Weiss

[11] Patent Number: 5,394,811

[45] Date of Patent: Mar. 7, 1995

[54] PROCESS FOR DRYING A WATER-CONTAINING FUEL IN DIRECT CONTACT WITH A HOT GRANULAR SOLID RESIDUE

[75] Inventor: Hans-Jürgen Weiss, Oberursel, Germany

[73] Assignee: Metallgesellschaft Aktiengesellschaft, Frankfurt am Main, Germany

[21] Appl. No.: 260,352

[22] Filed: Jun. 15, 1994

[30] Foreign Application Priority Data

Jun. 30, 1993 [DE] Germany ..... 43 21 680.3

[51] Int. Cl.[6] ..... F23B 7/00

[52] U.S. Cl. ..... 110/341; 34/359; 110/221; 110/224; 110/245; 122/4 D

[58] Field of Search ..... 34/9; 122/4 D; 110/245, 110/221, 224, 341

[56] References Cited

U.S. PATENT DOCUMENTS 4,326,470 4/1982 Maranhao ..... 110/324 X 4,414,905 11/1983 Beráner et al. ..... 110/245

*Primary Examiner*—Edward G. Favors

*Attorney, Agent, or Firm*—Herbert Dubno

[57] ABSTRACT

Dried fuel is at least partly combusted, gasified or carbonized in the presence of cooled solid residue in a reactor. Hot solid residue, which is at temperatures in the range from 500° to 1200° C., is withdrawn from the reactor and is mixed with water-containing fuel in the receiving region of a mechanical mixer, without a supply of fluidizing gas. The mixture is transported with further mixing from the receiving region of the mixer through a mixing section of 1 to 10 meters to an outlet. A fuel-containing, substantially water-free mixture at a temperature in the range from above 100° C. to 150° C. is fed from the outlet of the mixer to the reactor. A mixer which comprises two intermeshing shafts, which rotate in the same sense, may be employed in the process.

7 Claims, 1 Drawing Sheet

PROCESS FOR DRYING A WATER-CONTAINING FUEL IN DIRECT CONTACT WITH A HOT GRANULAR SOLID RESIDUE

FIELD OF THE INVENTION

The present invention relates to a process for drying a water-containing fuel in direct contact with a hot granular solid residue, wherein the dried fuel together with cooled residue is fed to a reactor and in the reactor is at least partly combusted, gasified or carbonized and residue thus obtained is directly contacted with the water-containing fuel.

BACKGROUND OF THE INVENTION

DE-A-37 26 643 describes a process in which brown coal having a considerable water content is intensely mixed with a hot combustion residue in a fluidized bed and the mixture is fed to a fluidized bed combustion chamber and is combusted therein. The flue gas rising from the combustion chamber entrains combustion residue and is passed through a cyclone and the residue is separated in the cyclone and is then fed to the fluidized bed and is mixed therein with the water-containing brown coal.

In that known process, gaseous products of carbonization, particularly carbon dioxide, methane and hydrogen, are withdrawn at certain rates together with vapor from the fluidized bed which serves to dry the brown coal. The products of carbonization are formed when previously dried brown coal is overheated in the fluidized bed. Such overheating cannot entirely be avoided because the fluidized bed essentially consists of a mixture of previously dried coal particles and cooled combustion residue. For this reason the hot residue will always be contacted with previously dried brown coal and that contact will result in a local overheating and carbonization. The products of carbonization in the water vapor involve in the first place a decrease of the heating value of the fuel mixture which is supplied to the fluidized-bed combustion chamber and in the second place are disturbing in the utilization of the water vapor which has been formed by the drying.

In the process known from DE-A-37 26 643, fluidizing steam is required at a considerable rate and that fluidizing steam must subsequently be dedusted together with the evaporated water and must be recycled to the fluidized bed by a compressor.

OBJECT OF THE INVENTION

It is therefore an object of the present invention to dry the water-containing fuel without the need for fluidizing steam and at low cost in such a manner that hot spots will be avoided and a water vapor will be formed substantially free of products of carbonization.

SUMMARY OF THE INVENTION

This object is accomplished in accordance with the invention in that hot solid residue at a temperature in the range from 500° C. to 1200° C. and water-containing fuel are mixed in the receiving region of a mechanical mixer without a supply of fluidizing gas, the mixture is transported with further mixing in the mixer from its receiving region through a mixing section of 1 to 10 meters in length to an outlet and a substantially water-free, fuel-containing mixture at a temperature in the range from above 100° C. to 150° C. is withdrawn from the outlet and is fed to the reactor.

A difference from the use of a fluidized bed resides in that the components are moved in co-current streams (inflow) in the mechanical mixer employed in the process in accordance with the invention.

In the receiving region of the mechanical mixer, hot combustion residue and fuel which is to be dried are brought together in a controlled manner so that dried fuel cannot be contacted with freshly supplied hot combustion residue. The mixing section which follows the receiving region of the mixer has a length of 1 to 10 meters and serves merely to effect the predetermined heat exchange between: the particles so that the evaporation of the water from the water-containing fuel is intensified and hot spots will be avoided.

The residence times of the particles in the mixer are typically in the range from 2 to 30 seconds.

The mixer which is employed in accordance with the invention can be a relatively simple apparatus because it is used at fairly low temperatures. By contrast, a fluidized bed is more expensive because it must be supplied with a fluidizing fluid. The known drying in a fluidized bed results in formation of aqueous vapors at a very large volume rate because these vapors contain also the fluidizing fluid, such as water vapors.

In the process in accordance with the invention the vapors to be dedusted, which are withdrawn from the mixer, have only one-half of that volume rate of flow. Besides, the total energy required in the process in accordance with the invention is much lower than the energy required for the drying in a fluidized bed because there is no need to compress the fluidizing fluid and because the mixer itself has low energy requirements.

Owing to the use of the mixing section of the mixer, it is possible to withdraw from the outlet of the mixer a mixture which is at a relatively low temperature, in the narrow temperature range from 103° to 130° C., and nevertheless to achieve an effective dewatering of the fuel.

It will be understood that a wide range of materials can be subjected to the process as a water-containing fuel, which may consist, e.g., of granular coal, granular brown coal or fuel containing sludge.

According to a further feature of the invention, a mixer is used which comprises two intermeshing shafts, which rotate in the same sense. Such mixers are known per se. Details have been disclosed in German Patents 1,252,621, 18 09 874 and 1,942,957 and in the corresponding U.S. Pat. Nos. 3,308,219, 3,655,518 and 3,674,449.

In the process in accordance with the invention the reactor in which the fuel-containing mixture is combusted, gasified or carbonized may be designed as desired. A non-circulating or circulating fluidized bed may be mentioned here only by way of example.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
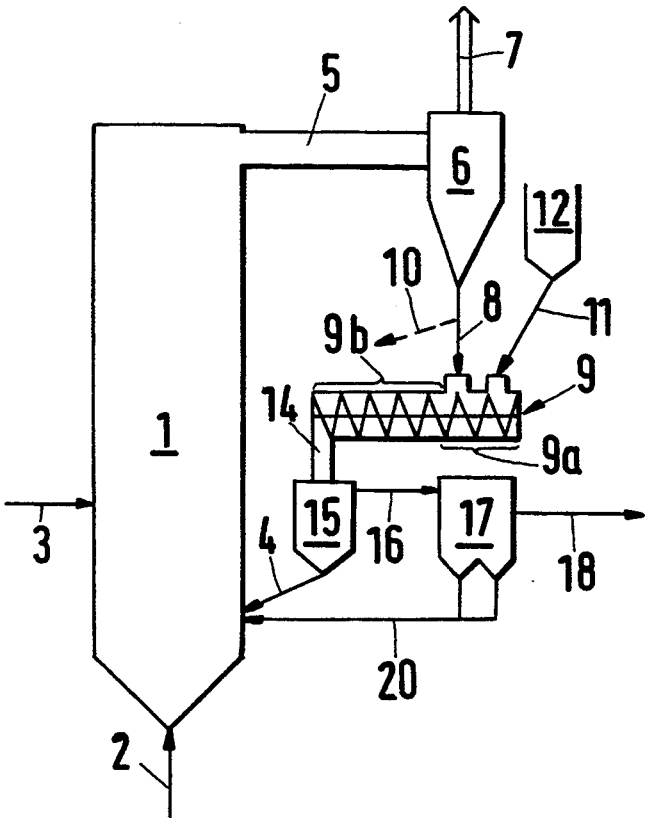
FIG. 1 is a diagram which illustrates the drying of the fuel together with the combustion in the circulating fluidized bed.

Granular fuel, which may consist, e.g., of brown coal, is combusted usually at temperatures in the range from 600° to 1200° C. in the fluidized bed combustion chamber 1, which is supplied with fluidizing air from line 2 and with secondary air from line 3. The fuel is supplied through line 4. Hot flue gas, in which combustion residue is entrained, flows through the duct 5 into a cyclone 6, in which gas and solids are separated. The flue gas leaves the cyclone 6 in line 7 and is cooled and purified in a manner which is known per se and not shown. Hot combustion residue flows from the cyclone 6 through the line 8 to a mixer 9. Any surplus may be discharged through the line 10 indicated by a broken line.

Basically in the same manner known, the chamber 1 may be used for a partial oxidation to effect a gasification or carbonization.

The mixer 9 is supplied through line 11 also with water-containing fuel, which comes from the supply bin 12. In the mixer 9 the water-containing cold fuel and the hot residue are first contacted with each other in the receiving region 9*a* so that the temperature of the hot combustion residue is rapidly decreased. The mixer comprises two screws which rotate in the same sense, and the mixture is transported with continuous mixing from the receiving region 9*a* through the mixing section 9*b* to the outlet 14 of the mixer.

The fuel-containing water-free mixture which is at a temperature in the range from above 100° C. to 150° C., preferably from 103° to 130° C., falls from the outlet 14 into an intermediate container 15 and is supplied from the latter through line 4 into the combustion chamber 1.

The water vapor formed by the drying of the water-containing fuel flows from the mixer 9 through the outlet 14 also into the intermediate container 15 and is then conducted through line 16 to a deduster 17 before the water vapor is withdrawn in line 18 for further use. Alternatively, the water vapor may also be directly withdrawn from the mixer and supplied to the deduster 17. The deduster 17 may consist, e.g., of an electrostatic precipitator or of a filter that comprises textile filter elements. Dust which has been separated in the deduster is also supplied to the combustion chamber 1 via the transport route 20.

Because the water vapor in line 18 is substantially free of products of carbonization, it can be used as an energy source.

Figure 2:
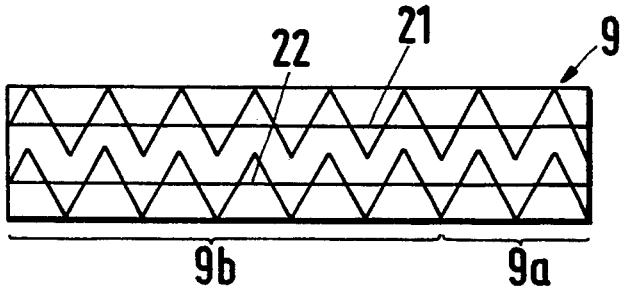
FIG. 2 is a schematic top plan view showing a mixer comprising two intermeshing shafts rotating in the same sense.

The mechanical mixer 9 may be designed in various ways and effects a mixing of the solid components and their transportation to the outlet 14 strictly mechanically without a need for a supply of a fluidizing gas. A possible design of such mixer is schematically shown in FIG. 2. Details have been described in the literature cited hereinbefore. That mixer comprises two intermeshing shafts 21 and 22, which rotate in the same sense and are schematically shown in FIG. 2 in a top plan view.

The mixture which has been formed in the receiving region 9*a* is transported by said shafts through the mixing section 9*b* to the outlet, which is not shown in FIG. 2. The mixer shown in FIG. 2 permits an intense mixing, as is particularly important in the receiving region 9*a*, so that the temperature of the hot solid residue decreases rapidly there. A strong mixing of the components in a radial direction, at right angles to the direction of transportation, is effected in the receiving region 9*a* and in the succeeding mixing section 9*b* whereas an axial back-mixing is substantially avoided. It is possible without difficulty to ensure that the fuel to be dried still contains some water at the transition from the receiving region 9*a* to the mixing section 9*b* and its drying is completed only in the mixing section 9*b* so that an overheating of the fuel is precluded.

EXAMPLE

In a plant as shown in FIG. 1 and provided with the mixer shown in FIG. 2, raw brown coal which contains 56% by weight water is combusted at 850° C. at a rate of 100,000 kg/h. Hot combustion residue at 850° C. is supplied through line 8 to the mixer 9 at a rate of 200,000 kg/h. Temperature at the outlet 14 is 110° C. and after a residence time of 6 seconds in the mixer the brown coal has at the outlet 14 a residual moisture content of 10% by weight. Dust-containing water vapor at 110° C. is withdrawn through line 16 and is dedusted in an electrostatic precipitator 17.

I claim:

1. A process for treating a water-containing fuel, comprising the steps of:

(a) feeding the fuel after drying to a dried fuel together with a cooled residue to a reactor for at least partial combustion, gasification or carbonization therein to produce a hot solid residue;

(b) recovering from said reactor said hot solid residue at a temperature in a range of 500° C. to 1200° C.;

(c) mixing said hot solid residue at said temperature in a range of 500° C. to 1200° C. with said water-containing fuel in a receiving region of a mechanical mixer and mixing said hot solid residue with said water-containing fuel in absence of any fluidizing gas in said receiving region to form a mixture, transporting said mixture mechanically with further mixing through a mixing section of a length of 1 to 10 meters to an outlet while driving water from said mixture, and recovering a substantially water-free fuel-containing mixture at a temperature in a range of above 100° C. to 150° C. from said outlet; and (d) feeding said substantially water-free fuel-containing mixture at a temperature in a range of above 100° C. to 150° C. to said reactor as dried fuel and cooled residue of step (a).

2. The process defined in claim 1 wherein said fuel containing mixture is withdrawn from said outlet at a temperature in the range of 103° to 130° C.

3. The process defined in claim 1 wherein said fuel has a residence time in said mixer of 2 to 30 seconds.

4. The process defined in claim 1 wherein said water-containing fuel is selected from the group which consists of granular bituminous coal, granular brown coal, granular lignite or a fuel-containing sludge.

5. The process defined in claim 1 wherein said mixer is elongated and comprises two intermeshing shifts rotatable in the same sense.

6. The process defined in claim 1 further comprising the step of operating said reactor with a non-circulating fluidized bed.

7. The process defined in claim 1 further comprising the step of operating said reactor as a circulating fluidized bed reactor.

* * * * *